US011821135B2

(12) United States Patent
Masters

(10) Patent No.: US 11,821,135 B2
(45) **Date of Patent: *Nov. 21, 2023**

(54) LAUNDRY TREATING APPLIANCE WITH A CONDENSER

(71) Applicant: WHIRLPOOL CORPORATION, Benton Harbor, MI (US)

(72) Inventor: Roy E. Masters, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/875,881

(22) Filed: Jul. 28, 2022

(65) Prior Publication Data

US 2022/0364294 A1 Nov. 17, 2022

Related U.S. Application Data

(63) Continuation of application No. 17/230,164, filed on Apr. 14, 2021, now Pat. No. 11,427,953, which is a (Continued)

(51) Int. Cl.
*D06F 58/24* (2006.01)
*A47L 15/00* (2006.01)
(Continued)

(52) U.S. Cl.
CPC ..... *D06F 58/24* (2013.01); *A47L 15/0097* (2013.01); *D06F 25/00* (2013.01); *D06F 37/26* (2013.01); *D06F 58/04* (2013.01)

(58) Field of Classification Search
CPC ..... D06F 58/04; D06F 58/24; D06F 25/00; D06F 37/26; A47L 15/0097
(Continued)

(56) References Cited

U.S. PATENT DOCUMENTS 2,644,245 A * 7/1953 Hammell ..... D06F 58/24 34/131
3,018,562 A * 1/1962 Orr ..... D06F 58/24 261/103
(Continued)

FOREIGN PATENT DOCUMENTS

CN 1500934 A 6/2004
CN 1827901 A 9/2006
(Continued)

OTHER PUBLICATIONS

Chinese Office Action for Counterpart CN202011012685.3, dated May 30, 2023, 8 Pages.

*Primary Examiner* — Stephen M Gravini
(74) *Attorney, Agent, or Firm* — McGarry Bair PC

(57) ABSTRACT

A laundry treating appliance comprising a combination washer/dryer having a cabinet defining an interior, a tub located within the interior with a first access opening, a rotatable drum located within the tub and having a rear wall defining a fan, a closure moveably mounted to the cabinet and selectively movable between open/closed positions to open/close at least one of the first and second access openings; an air recirculation conduit having an inlet fluidly coupled to a first portion of the treating chamber and an outlet fluidly coupled to a second portion of the treating chamber, which is different than the first portion, and a condenser fluidly coupled to the recirculation conduit.

20 Claims, 9 Drawing Sheets

Related U.S. Application Data continuation of application No. 16/586,841, filed on Sep. 27, 2019, now Pat. No. 10,995,448.

(51) Int. Cl.
*D06F 25/00* (2006.01)
*D06F 37/26* (2006.01)
*D06F 58/04* (2006.01)

(58) Field of Classification Search
USPC ..... 34/595–610
See application file for complete search history.

(56) References Cited

U.S. PATENT DOCUMENTS

| | | | | |
|---|---|---|---|---|
| 3,805,404 | A | 4/1974 | Gould | |
| 3,866,333 | A | 2/1975 | Sarukahanian et al. | |
| 4,270,281 | A | 6/1981 | Muller | |
| 4,489,507 | A | 12/1984 | Kawai | |
| 4,621,438 | A * | 11/1986 | Lanciaux | D06F 58/06 34/604 |
| 5,232,476 | A | 8/1993 | Grant | |
| 6,904,703 | B2 | 6/2005 | Naganawa et al. | |
| 7,062,863 | B2 | 6/2006 | Chung | |
| 7,228,647 | B2 | 6/2007 | Hong | |
| 7,634,925 | B2 | 12/2009 | Lim et al. | |
| 8,112,903 | B2 | 2/2012 | Favret et al. | |
| 8,496,760 | B2 | 7/2013 | Bertsch et al. | |
| 8,776,394 | B2 | 7/2014 | Catauro et al. | |
| 8,863,405 | B2 * | 10/2014 | Lee | D06F 58/20 34/139 |
| 9,249,538 | B2 | 2/2016 | Bison et al. | |
| 9,279,211 | B2 | 3/2016 | Kim et al. | |
| 9,510,728 | B2 | 12/2016 | Tuller | |
| 9,567,700 | B2 * | 2/2017 | Hong | D06F 43/088 |
| 9,976,249 | B2 | 5/2018 | Lv et al. | |
| 10,179,967 | B2 | 1/2019 | Ozdemir et al. | |
| 10,494,756 | B2 | 12/2019 | Beers et al. | |
| 10,544,539 | B2 | 1/2020 | Bocchino et al. | |
| 10,619,289 | B2 | 4/2020 | Bocchino et al. | |
| 10,648,125 | B2 | 5/2020 | Masters et al. | |
| 10,662,574 | B2 | 5/2020 | Bocchino et al. | |
| 10,793,994 | B2 | 10/2020 | Hong et al. | |
| 10,995,448 | B2 * | 5/2021 | Masters | D06F 58/04 |
| 11,452,964 | B2 * | 9/2022 | Masters | B01D 46/79 |
| 2005/0223583 | A1 | 10/2005 | Lee et al. | |
| 2010/0107703 | A1 | 5/2010 | Hisano et al. | |
| 2015/0259847 | A1 | 9/2015 | Kohavi et al. | |
| 2016/0115641 | A1 | 4/2016 | Kim et al. | |
| 2016/0153135 | A1 | 6/2016 | Ryoo et al. | |
| 2017/0175320 | A1 | 6/2017 | Masters et al. | |
| 2020/0063329 | A1 | 2/2020 | Bocchino et al. | |
| 2021/0230790 | A1 | 7/2021 | Masters | |
| 2021/0275957 | A1 | 9/2021 | Masters et al. | |
| 2022/0364294 | A1 * | 11/2022 | Masters | D06F 25/00 |

FOREIGN PATENT DOCUMENTS

| | | | | |
|---|---|---|---|---|
| CN | 113355882 | A * | 9/2021 | B01D 46/0082 |
| DE | 3903184 | A1 | 8/1990 | |
| EP | 1936022 | A1 | 6/2008 | |
| EP | 2339063 | B1 | 4/2014 | |
| EP | 3181751 | A1 | 6/2017 | |
| EP | 3252221 | A1 | 12/2017 | |
| EP | 3279393 | A1 | 2/2018 | |
| EP | 3798354 | A1 | 3/2021 | |
| EP | 3875674 | A1 * | 9/2021 | B01D 46/0082 |
| JP | H05146593 | A | 6/1993 | |
| JP | H0975596 | A | 3/1997 | |
| JP | 2018047066 | A | 3/2018 | |
| KR | 20070078326 | A | 7/2007 | |
| KR | 20130051584 | A | 5/2013 | |
| WO | 2018026092 | A1 | 2/2018 | |

* cited by examiner

LAUNDRY TREATING APPLIANCE WITH A CONDENSER

CROSS-REFERENCE TO RELATED APPLICATIONS

This application is a continuation application of U.S. patent application Ser. No. 17/230,164 filed on Apr. 14, 2021, now U.S. Pat. No. 11,427,953, issued Aug. 30, 2022, which is a continuation application of U.S. patent application Ser. No. 16/586,841 filed on Sep. 27, 2019, now U.S. Pat. No. 10,995,448, issued May 4, 2021, both of which are hereby incorporated herein by reference in their entirety.

BACKGROUND

Laundry treating appliances, such as clothes washers, clothes dryers, combination washer/dryers, refreshers, and non-aqueous systems, can have a configuration based on a rotating drum/basket that defines a treating chamber having an access opening through which laundry items are placed in the treating chamber for treating. The laundry treating appliance can have a controller that implements a number of pre-programmed cycles of operation having one or more operating parameters.

In laundry treating appliances with drying systems, typically a heater and a blower are fluidly coupled to an air conduit to move heated process air through the conduit and into the treating chamber to evaporate water from a load of laundry. In a traditional, open-loop, drying system, the blower moves the water-laden air to an exterior of the laundry treating appliance, typically outside of the building housing the laundry treating appliance. In a less traditional, closed-loop, drying system, like a heat pump drying system, the water-laden air is passed through a condenser to remove the water, and the process air is heated again by the heater and blown back into the treating chamber to continue the process.

BRIEF SUMMARY

In one aspect, the description relates to a combination washer/dryer, for washing and drying laundry having a cabinet defining a cabinet interior with at least one exterior wall at least partially enclosing the interior, a tub located within the cabinet interior and defining a tub interior with a first access opening, a rotatable drum located within the tub interior for rotation about a rotation axis and defining a treating chamber with a second access opening, which is aligned with the first access opening; the rotatable drum comprising a rear wall defining a fan, a closure moveably mounted to the cabinet and selectively movable between open/closed positions to open/close at least one of the first and second access openings, an air recirculation conduit having an inlet fluidly coupled to a first portion of the treating chamber and an outlet fluidly coupled to a second portion of the treating chamber, which is different than the first portion, and a condenser fluidly coupled to the recirculation conduit.

DETAILED DESCRIPTION

Figure 1:
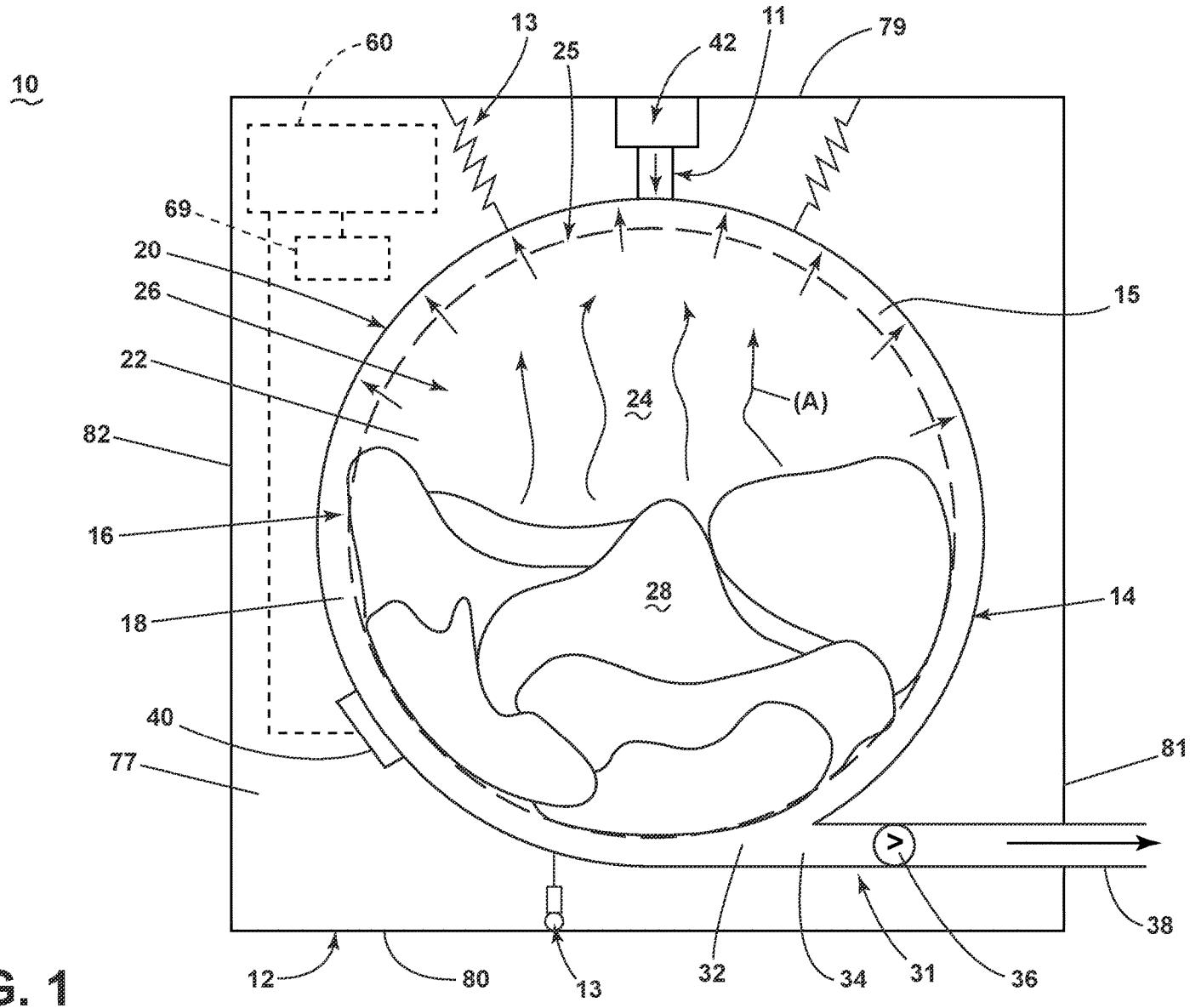
FIG. 1 is a schematic front view of a laundry treating appliance, illustrated as a combination washer/dryer, incorporating a drying system according to an aspect of the disclosure.

Aspects of the present disclosure relate to a drying system for a laundry treating appliance. The drying system includes an air recirculation loop with a condenser that utilizes a temperature difference between hot-humid air leaving a treating chamber in the drying system and ambient air to cool the air and condense the water vapor. The drying system can be used in any type of laundry treating appliance needing to dry laundry, such laundry treating appliances can be a clothes dryer or a combination washer/dryer (combo).

Traditional combo washer/dryer appliances are based on the combined structure of a traditional washing machine and clothes dryer contained within a cabinet having an industry-standard form factor, suitable for a stand-alone washer or dryer, and must house both washing and drying systems, the treating chamber volume, typically defined by a rotatable drum, is generally smaller than a typical stand-alone drying appliance. Even with typically lesser capacity, combo machines are very convenient for users who have limited space and/or low laundry volumes.

Traditional drying systems include a blower to drive heated drying air or process air into and out of the drum during a drying cycle. The blower drives the air through a heater, to heat the air, and into the drum where the heated air aids in the evaporation of water from the load to form water-laden air, and the blower moves the water-laden air out of drum. For the most common type of dryer, an open loop system is used, where the water laden air is expelled to the surrounding environment. For condensing type dryers, a closed loop system is used where the water laden air is passed through a condenser to remove the water and then recirculated.

For condensing type dryers, the condenser chamber is typically located in the cabinet interior. The interior of the cabinet, during operation, tends to be much hotter than the surrounding ambient room temperature air. Since the efficiency of a condenser is dependent on the temperature differential between the condenser exterior/interior, locating the condenser inside the cabinet, where it is much hotter than ambient, reduces the efficiency of the condenser, requiring an increased amount of energy to cool the condenser. Further, the condenser takes up space that could be used to increase the size of the treating chamber, such as the drum, thereby increasing the capacity of the laundry treating appliance, or reduce the form factor of the laundry treating appliance. The condenser of the present disclosure includes one or more walls at least partially formed by an exterior wall of the cabinet in order to utilize the cooler ambient room air to cool and condense the water vapor from the humid air leaving the treating chamber and thus decrease the amount of energy required to cool and remove water from the process air. Forming at least a portion of a condenser chamber with an exterior wall of the cabinet can also decrease the amount of space required by the condenser.

In addition, the blower generates a lot of noise relative to the other components of the drying system. Any reduction in operational noise of a laundry treating appliance is typically considered a positive by a user of the appliance. The blower also takes up space that could be used to increase the size of the treating chamber, such as the drum, thereby increasing the capacity of the laundry treating appliance, or reduce the form factor of the laundry treating appliance. The drying system of this disclosure eliminates the blower, which is beneficial in reducing the noise of the drying system and providing for increased capacity or smaller form factor of the corresponding laundry treating appliance.

FIG. 1 is a schematic view of a laundry treating appliance, illustrated in the form of a combination washer/dryer 10. While the laundry treating appliance described herein has a horizontal axis, the exemplary laundry treating appliance is not limited to implementations in a horizontal axis laundry treating appliance. Depending on the implementation, a vertical axis dryer or a combination washing machine and dryer; a tumbling or stationary refreshing/revitalizing machine; an extractor; or a non-aqueous washing apparatus; can all be suitable environments for the disclosure as described herein.

The combination washer/dryer 10 as illustrated in FIG. 1 includes a structural support system comprising a cabinet 12. The cabinet 12 can be a housing having a chassis and/or a frame comprising one or more exterior walls which can include a front wall 77, a rear wall 78 (FIG. 3) opposite the front wall 77, a top wall 79, a bottom wall 80 opposite the top wall 79, and first and second opposing side walls 81, 82, defining an interior, enclosing components typically found in a conventional washer and dryer or combo washer/dryer, including but not limited to motors, pumps, fluid lines, controls, sensors, transducers, and the like. Only components necessary for a complete understanding of the disclosure set forth herein will be described in more detail as necessary.

A laundry holding system is located within the interior of the cabinet 12 and includes a tub 14 supported within the cabinet 12 by a suitable suspension system 13, and a drum 16 located within the tub 14 and separated by a space 15 between the tub 14 and the drum 16. The tub 14 defines a tub interior 18 with a first access opening 20. The drum 16 is mounted for rotation relative to the tub 14. An interior 22 of the drum 16 at least partially defines a laundry treating chamber 24 with a second access opening 26, aligned with the first access opening 22, and configured to hold a laundry load 28. The drum 16 includes perforations 25 fluidly coupling the laundry treating chamber 24 to the tub 14. A moveable door 30 (FIG. 3) can be provided to close or open the access openings 22, 26.

The combination washer/dryer 10 can also include a recirculation and drain system 31 for recirculating liquid and draining liquid from the combination washer/dryer 10. Liquid supplied to the tub 14 typically enters the space 15 between the tub 14 and the drum 16 and can flow by gravity to a sump 32, which while illustrated as being formed in part by a lower portion of the tub 14, it could be remote from the tub. For example, the sump 32 can also be formed by a sump conduit 34, fluidly coupling the lower portion of the tub 14 to a pump 36. The pump 36 can direct liquid to a drain conduit 38, which can drain the liquid from the combination washer/dryer 10, or, alternatively, to a recirculation system to recirculate and direct the liquid back into the drum 16 or the tub 14.

The combination washer/dryer 10 also includes a heating system for providing heat to a washing system and/or a drying system of the combination washer/dryer 10. The heating system includes a heater 40 for providing heat to the heating system.

The combination washer/dryer 10 further includes the drying system 11 for drying laundry items. The drying system 11 comprises an air recirculation conduit 42 that is fluidly coupled to and recirculates air (A) through the treating chamber 24.

Figure 2:
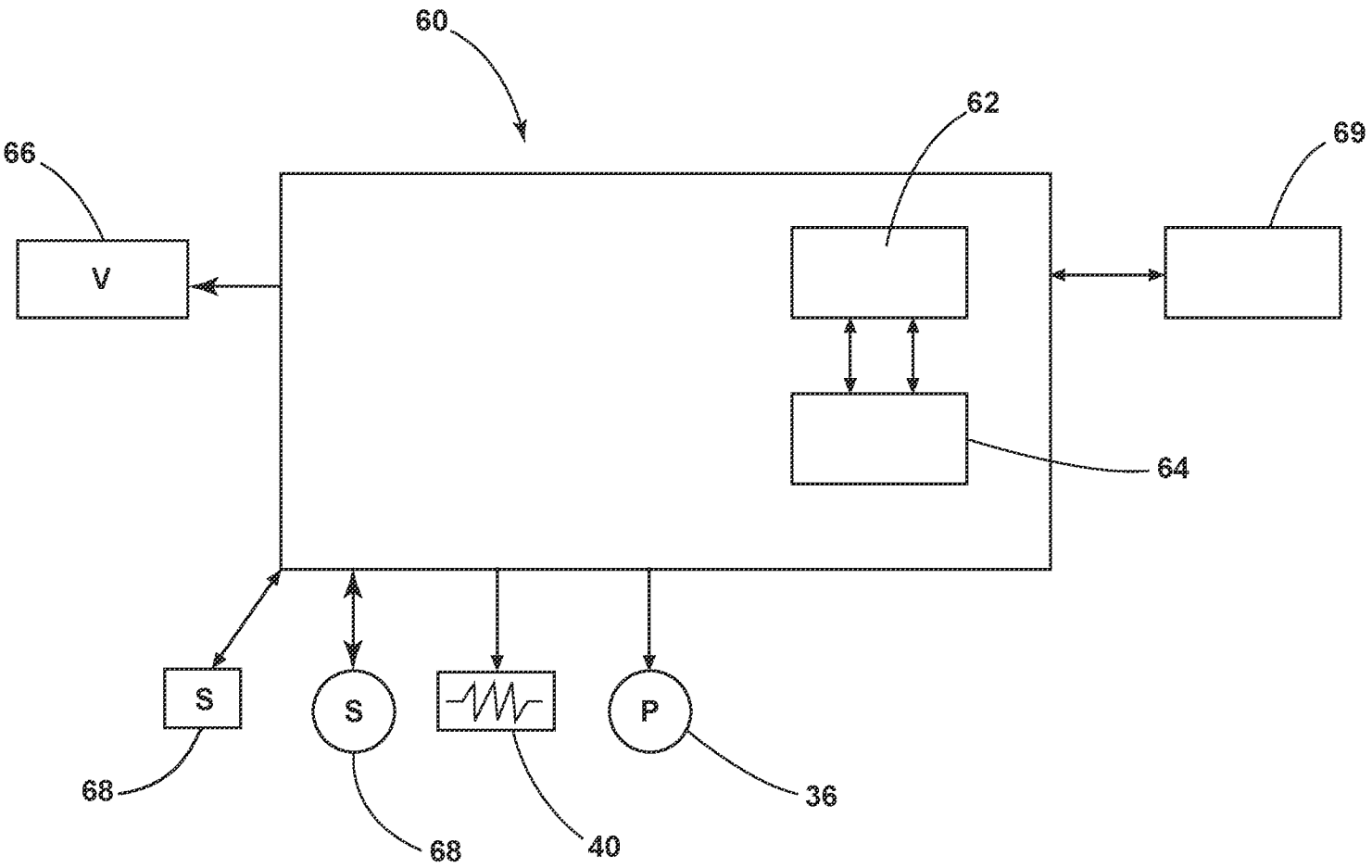
FIG. 2 is a schematic view of a control system of the laundry treating appliance of FIG. 1.

FIG. 2 is a schematic view of the controller 60 for the combination washer/dryer 10. The controller 60 can be provided with a memory 62 and a central processing unit (CPU) 64. The memory 62 can be used for storing the control software that is executed by the CPU 64 in completing a cycle of operation using the combination washer/dryer 10 and any additional software. The memory 62 can also store information, such as a database or table, and to store data received from one or more components of the combination washer/dryer 10 that may be communicably coupled with the controller 60. The database or table can store the various operating parameters for the one or more cycles of operation, including factory default values for the operating parameters and any adjustments to them by the control system or by user input.

The controller 60 can be operably coupled with one or more components of the combination washer/dryer 10 for communicating with and controlling the operation of the component to implement a cycle of operation. For example, the controller 60 can operably couple with the pump 36, the heater 40, and one or more other components 66 of the combination washer/dryer 10 including but not limited to a motor, a dispenser, a steam generator, a sump heater, a heating element, blower, thermistor, thermostat, thermal fuse, thermistor, moisture sensor, valves, and pumps to control the operation of these and other components to implement one or more of the cycles of operation.

The controller 60 can also be coupled with one or more sensors 68 provided in one or more of the systems of the combination washer/dryer 10 to receive input from the sensors, which are known in the art and not shown for simplicity. Non-limiting examples of sensors 68 that may be communicably coupled with the controller 60 include: a treating chamber temperature sensor, a moisture sensor, a weight sensor, a chemical sensor, a position sensor and a motor torque sensor, which may be used to determine a variety of system and laundry characteristics, such as laundry load inertia or mass.

The controller 60 is also operably coupled to the user interface 69 to receive input from the user through the user interface 69 for the implementation of a cycle of operation. The user interface 69 can include operational controls such as dials, lights, knobs, levers, buttons, switches, and displays enabling the user to input commands to a controller 60 and receive information about a treatment cycle of operation from components in the combination washer/dryer 10 or via input by the user through the user interface 69. The user can enter many different types of information, including, without limitation, fabric type, cycle selection and cycle parameters, such as cycle options.

In an exemplary method of operation, a user can select a predetermined cycle or fabric type of the laundry load at the user interface 69. Optionally, one or more of the sensors 68 can send input to the controller 60 such that the controller 60 can determine the optimal cycle parameters for the laundry load.

Figure 3:
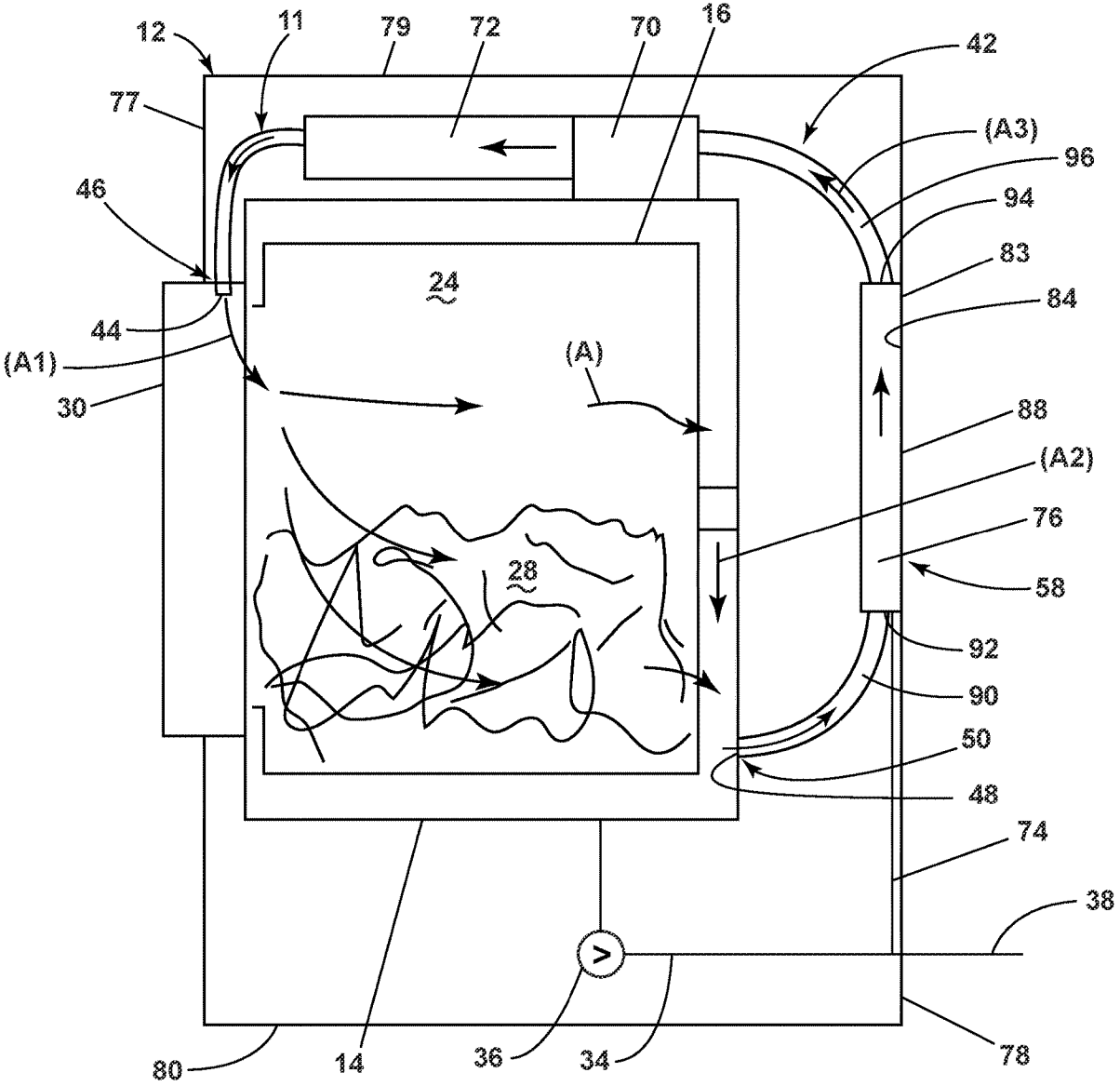
FIG. 3 is a schematic side cross-sectional view of the laundry treating appliance of FIG. 1.

FIG. 3 is a schematic cross-sectional, side view of the drying system 11, which further illustrates the drying system 11 as including a blower 70, and a heating element 72, which are fluidly coupled to the air recirculation conduit 42, downstream of a condenser 58. While shown together and downstream of the condenser 58, the blower 70 and heating element 72 can be spaced from each other, including on opposite sides of the condenser 58, and located upstream of the condenser 58.

The air recirculation conduit 42 includes an inlet 44 fluidly coupled to a first portion 46 of the treating chamber 24, and an outlet 48 fluidly coupled to a second portion 50 of the treating chamber 24. The air recirculation conduit 42 fluidly couples the inlet 44 and the outlet 48 to the treating chamber 24. A condenser 58 is located in the air recirculation conduit 42 to condense water vapor in process air (A) recirculating in the air recirculation conduit 42 during by a drying cycle. The condenser 58 can be provided with a condenser drain conduit 74 that fluidly couples the condenser 58 with the pump 36 and the drain conduit 38. Condensed liquid within the condenser 58 can flow through the condenser drain conduit 74 to the pump 36, where it can be provided to the recirculation and drain system 31.

The condenser 58 further includes a condensing chamber 76 where one or more walls of the condensing chamber 76 are formed by a portion of one or more exterior walls of the cabinet 12. In an exemplary aspect, the condenser 58 can be provided at a rear portion of the cabinet 12. A first portion 83 of the rear wall 78 of the cabinet 12 at least partially forms a condenser wall 84 of the condensing chamber 76. The condenser wall 84 can at least partially define one or more condensing surfaces 88, interior to the condensing chamber 76, and the condensing surfaces 88 can optionally include an enlarged surface area formed of a plurality of fins or a surface pattern configured to increase the overall surface area of the condensing surfaces 88 to increase an amount of the condensing surface area available in the condensing chamber 76.

In a drying operation, the blower 70 can force drying air past the heating element 72, where the drying air is heated, through the inlet 44 and into the treating chamber 24, as shown by the arrows (A1). While in the treating chamber 24, the drying air picks up moisture from the laundry load. The now humid air exits the treating chamber 24 via the outlet 48, as shown by the arrows (A2), and enters a condenser inlet duct 90 of the air recirculation conduit 42, and flows into condenser 58 to the condensing chamber 76 through a condensing chamber inlet 92. The exposure of the rear wall 78 to ambient air on an exterior face, cools the condenser wall 84 interior to the condensing chamber 76 such that the temperature of the condensing surface 88, formed by the condenser wall 84, is lower than the temperature of the hot humid air (A2) as the air enters the condensing chamber 76. Water vapor in the air (A2) will transfer heat to the condensing surface 88 and the air (A2) will cool as water vapor condenses out of the air flow and thus dry, cooled air, illustrated by the arrows (A3), exits a condensing chamber outlet 94, and enters a condenser outlet duct 96 of the air recirculation conduit 42, and returns to the heating element 72 via the blower 70.

Figure 4:
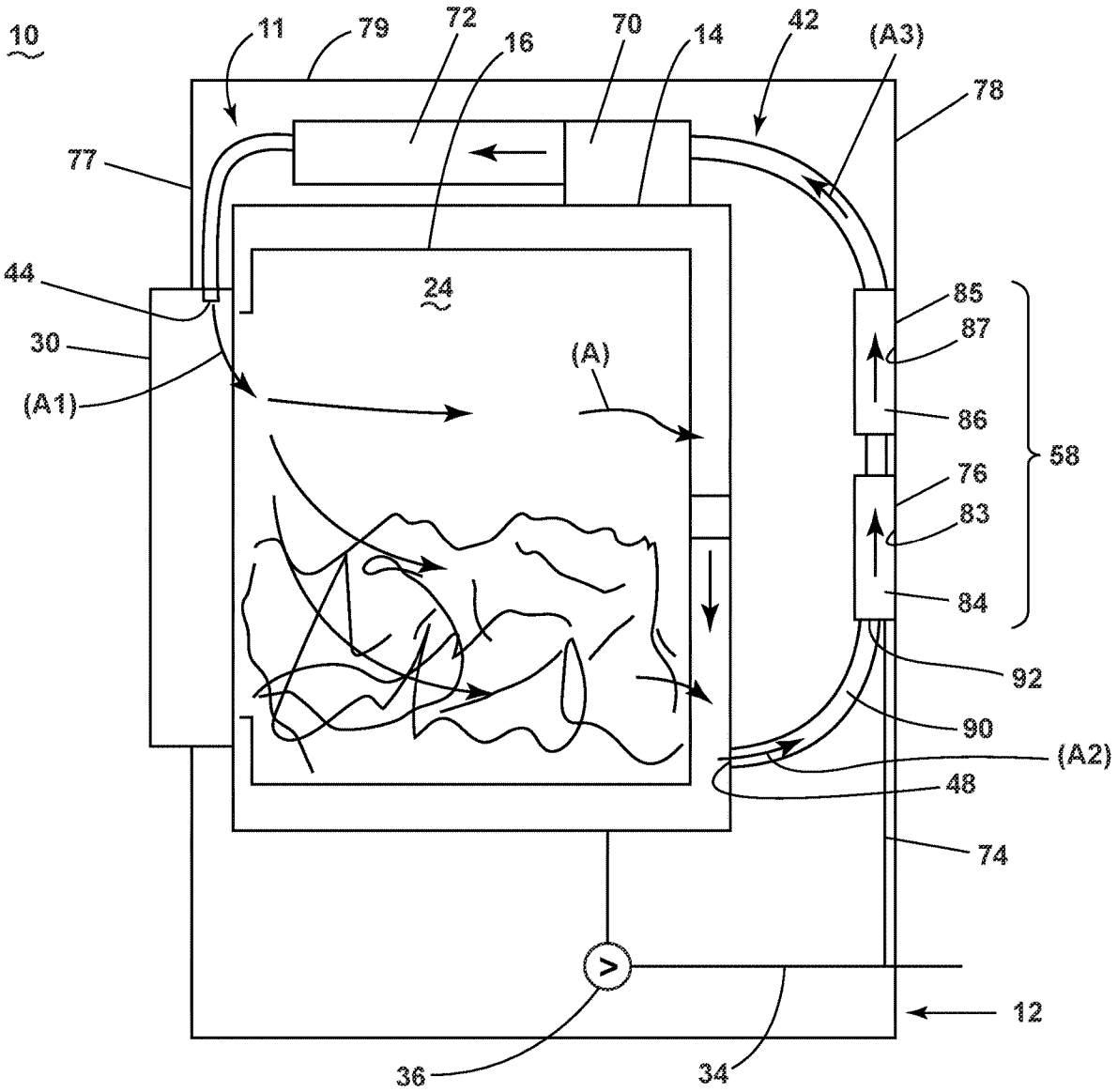
FIG. 4 is a schematic side cross-sectional view of the laundry treating appliance of FIG. 3 incorporating a condenser according to another aspect of the disclosure.

In another aspect, as illustrated in FIG. 4, the condenser 58 can include a second condensing chamber 86 having a condenser wall 87 formed by a second portion 85 of the rear wall 78. The two condensing chambers 76, 86 can be fluidly coupled. However, it is contemplated that they can be fluidly separate, such as by branching the ducts 90 and 96.

Alternatively, while the condensing chambers 76, 86 are illustrated as having respective condenser walls 84, 87 formed by portions 83, 85 of the rear wall 78 of the cabinet 12, it is to be understood that any wall of the condensing chambers 76, 86 can be formed from at least a portion of any one or more of the front 77, side 81, 82, top 79 or bottom 80 exterior walls of the cabinet 12. The condensing chambers 76, 86 can be on entirely different walls or on different portions of the same wall.

While two condensing chambers 76, 86 are illustrated, there can be any number of the condensing chambers, which can be located on the same or different walls. It is contemplated that there can be a plurality of condensing chambers located on different walls and/or different portions of the same wall, resulting in a series of distributed condensing chambers.

Figure 5:
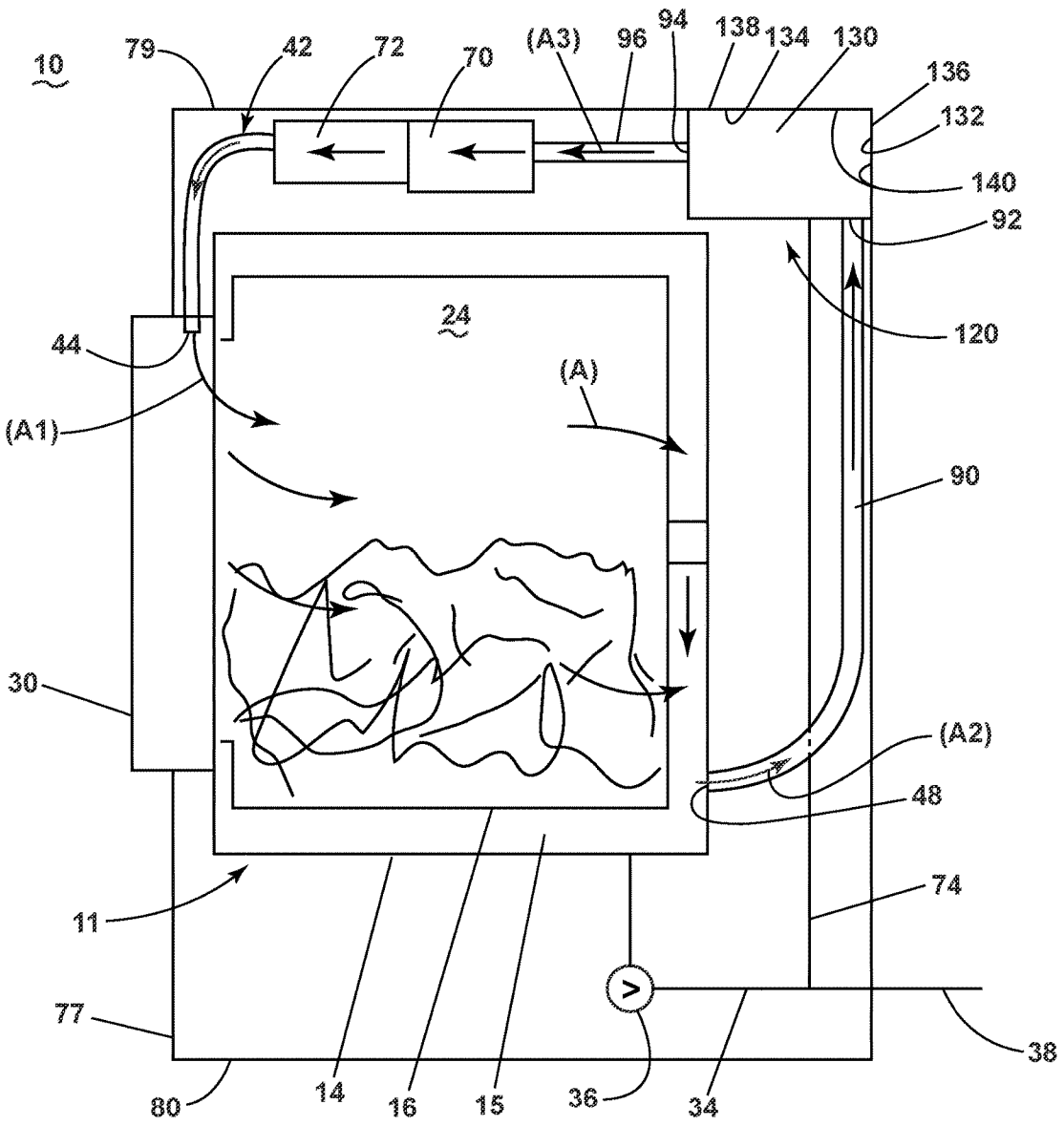
FIG. 5 is a schematic side cross-sectional view of the laundry treating appliance of FIG. 3 incorporating a condenser according to another aspect of the disclosure.

FIG. 5 is a schematic side cross-sectional view of a variation of the condenser 58 as previously described for the combination washer/dryer 10 and illustrated as condenser 120. As this variation has many similar parts as previously described, like parts are identified with like numerals, with it being understood that the description of the like parts of the combination washer/dryer 10 apply unless otherwise noted.

A condenser 120 primarily differs from the condenser 58 of the combination washer/dryer 10 in that a condensing chamber 130 is formed, at least in part, with more than one exterior wall of the cabinet 12. As illustrated, the condensing chamber 130 includes an outer wall 132 and an upper wall 134. The outer wall 132 is defined by a portion 136 of the rear wall 78 of the cabinet 12 and the upper wall 134 is defined by at least a portion 138 of the top wall 79 of the cabinet 12. Alternatively, the entire top wall 79 of the cabinet 12 can form the upper wall 134 of the condensing chamber 130. Likewise, the entire rear wall 78 of the cabinet 12 can form the outer wall 132 of the condensing chamber 130. In another exemplary aspect, the condensing chamber 130 can be defined with all or any portions of any one or more of the front 77, side 81, 82, top 79 or bottom 80 exterior walls of cabinet 12. Further, any one or more wall surfaces of the condensing chamber 130 can define a condensing surface 140 and can optionally include an enlarged surface area formed of a plurality of fins or a surface pattern configured to increase the overall surface area of any one or more walls of the condensing chamber 130 to increase an amount of the condensing surface 140 available in the condensing chamber 130.

Figure 6:
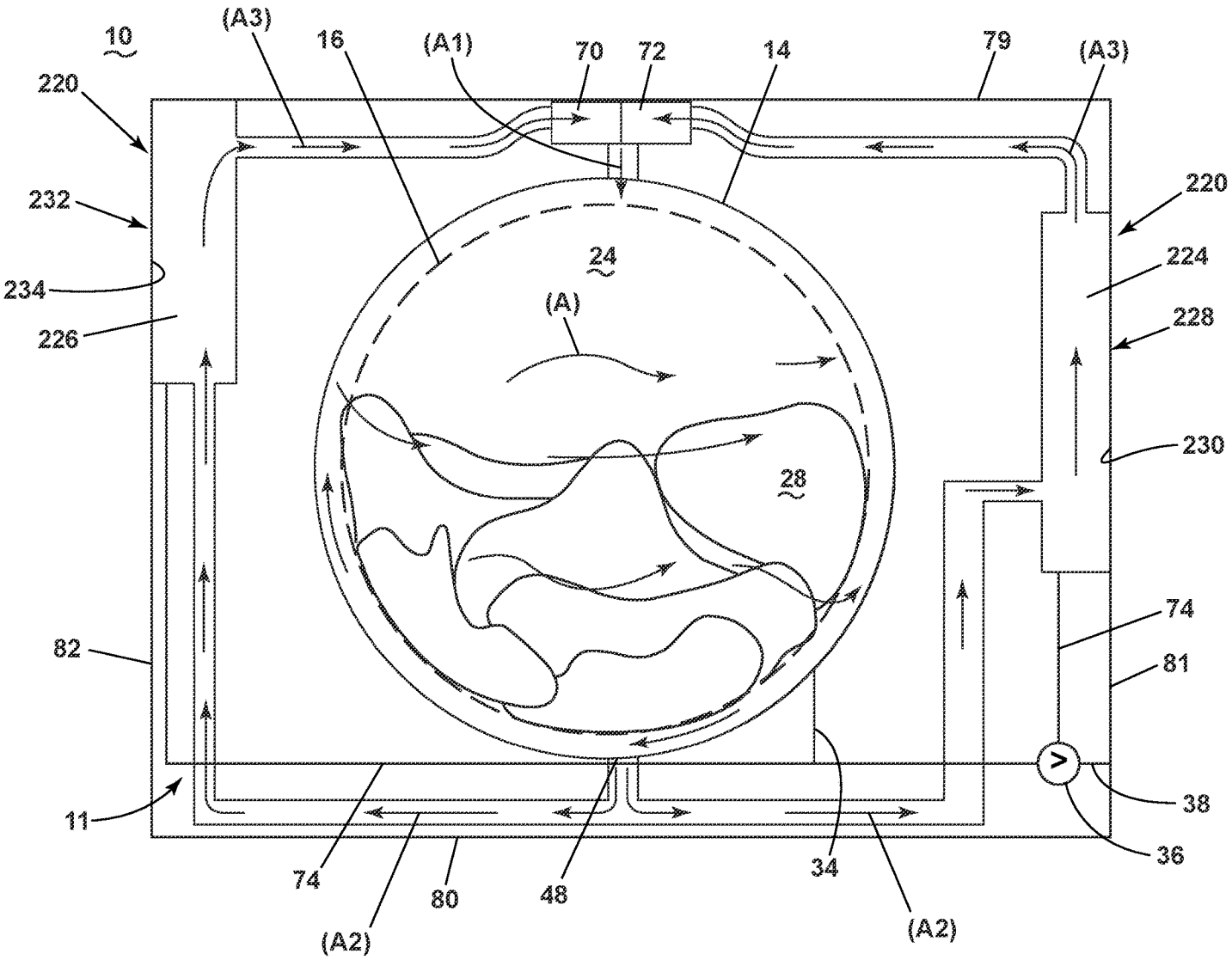
FIG. 6 is a schematic front view of the laundry treating appliance of FIG. 3 incorporating a condenser according to another aspect of the disclosure.

FIG. 6 is a schematic front view of another variation to the condenser 58 as previously described for the combination washer/dryer 10 and illustrated as condenser 220. As this variation has many similar parts as previously described, like parts are identified with like numerals with it being understood that the description of the like parts of the combination washer/dryer 10 apply unless otherwise noted.

The condenser 220 of the combination washer/dryer 10 primarily differs from the condenser 58 of the combination washer/dryer 10 in that the condenser 220 comprises multiple condensing chambers where each condensing chamber is at least partially formed by a portion of one or more exterior wall of the cabinet 12. As illustrated in FIG. 6, the condenser 220 comprises a first condensing chamber 224 and a second condensing chamber 226. A portion 228 of the first side wall 81 of the cabinet 12 defines an outer wall 230 of the first condensing chamber 224. Similarly, a portion 232 of the second side wall 82 of the cabinet 12 defines an outer wall 234 of the second condensing chamber 226. Optionally, another exterior wall of the cabinet 12 can form another portion of either the first condensing chamber 224, the second condensing chamber 226, or both. Alternatively, each of the first and second condensing chambers 224, 226 can be at least partially formed by any one or more of the front 77, side 81, 82, top 79 or bottom 80 exterior walls of the cabinet 12.

Figure 7:
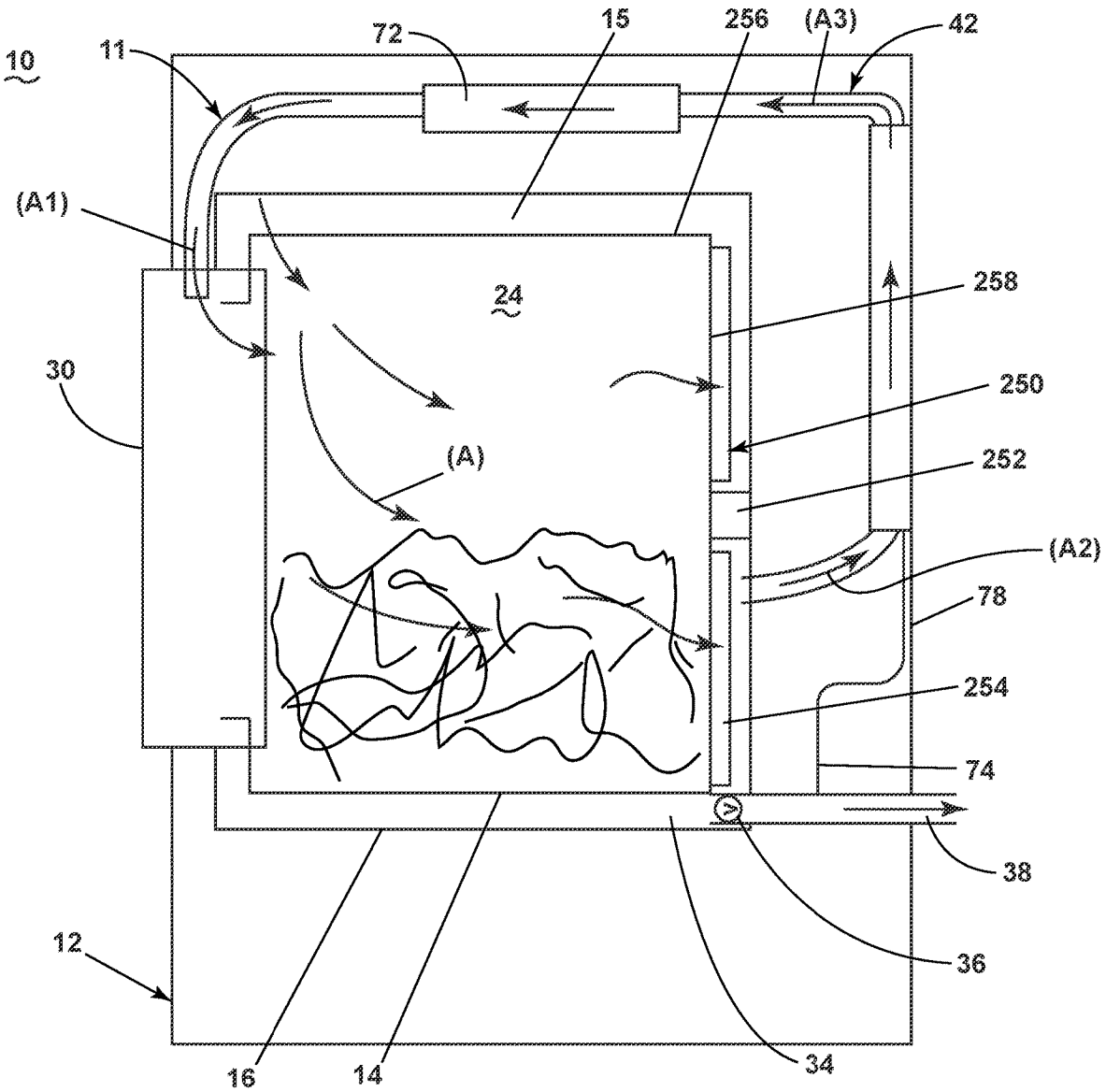
FIG. 7 is a schematic side cross-sectional view of the laundry treating appliance of FIG. 3 incorporating a condenser according to another aspect of the disclosure.

FIG. 7 is a schematic cross-sectional view of a variation of the drying system 11 of FIG. 1 where the blower 70 is replaced by a fan 250 provided at the rear of the drum 16 in any of the previously described drying system 11 condenser configurations. As this variation has many similar parts as previously described, like parts are identified with like numerals, with it being understood that the description of the like parts of the combination washer/dryer 10 apply unless otherwise noted.

As illustrated in FIG. 7, the air recirculation conduit 42 of the drying system 11 does not include a blower 70 to force process air (A) through the air recirculation conduit 42. Instead, drying process air flow (A) is driven by rotation of the drum 16. A peripheral wall 256 and an end wall 258 define the interior 22 of the drum 16. The end wall 258 comprises a drive shaft 252 mounted to the end wall 258, and the fan 250. During a drying cycle, the drive shaft 252 rotates the drum 16 at a speed where the laundry 28 tumbles in the drum 16. During rotation of the drum 16, the drive shaft 252 rotates the fan 250. The one or more vanes 254 rotate with the drum 16 providing enough centrifugal air flow to drive the process air (A) out of the drum 16, into the tub 14, through the air recirculation conduit 42, and into the condenser 58. While the condenser 58 is illustrated as formed by the rear wall 78 of the cabinet 12 as discussed in FIG. 3, it is to be understood that the condenser 58 can be configured as any of the condensers 58, 120, 220 previously discussed.

Figure 8:
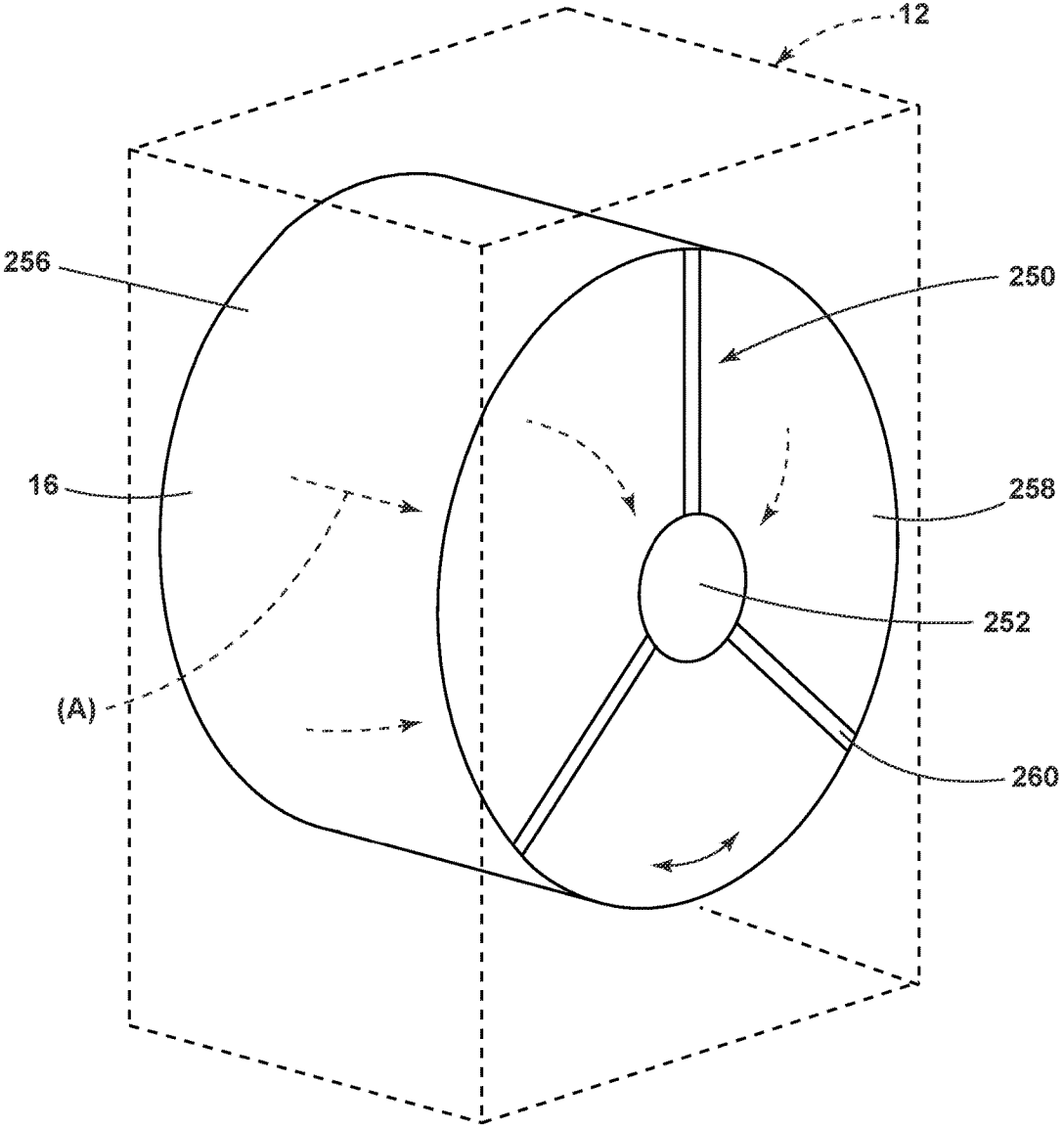
FIG. 8 schematic perspective view of the laundry treating appliance of FIG. 1, incorporating a drum according to another aspect of the disclosure.

FIG. 8 is a schematic perspective view of the drum 16 of the combination washer/dryer 10 according to an aspect of the present disclosure. The end wall 258 of the drum 16 includes the fan 250 in the form of one or more ribs 260, radially spaced from the drive shaft 252, to drive the process air (A) as the drum 16 rotates as well as provide structural support to the end wall 258 of the drum 16. The ribs 260 can be mounted onto the end wall 258 or unitarily formed with the end wall 258.

Figure 9:
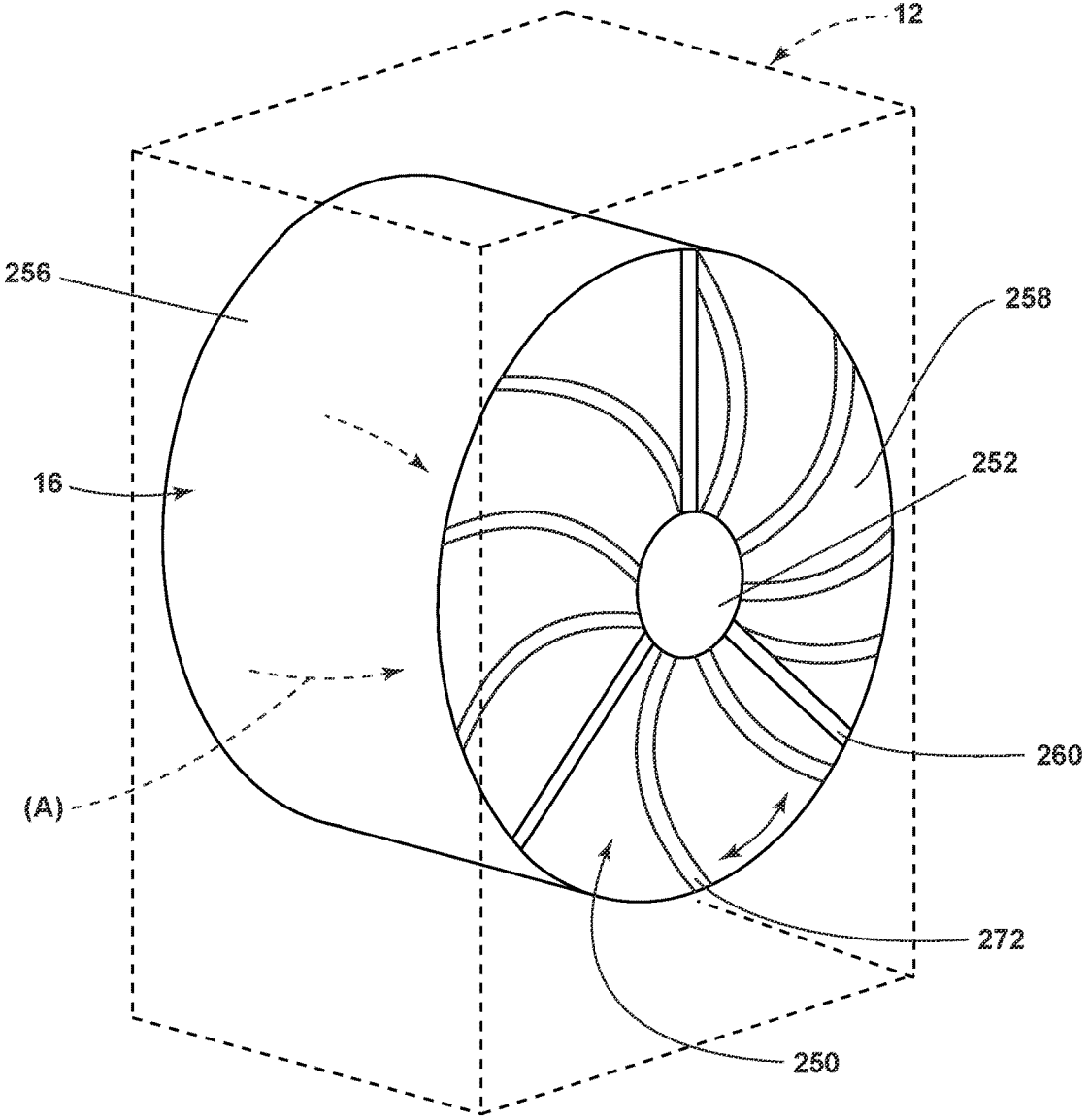
FIG. 9 schematic perspective view of the laundry treating appliance of FIG. 8, incorporating a drum according to another aspect of the disclosure.

FIG. 9 is a schematic perspective view of the end wall 258 of the drum 16 of the combination washer/dryer 10 according to another aspect of the present disclosure. The end wall 258 of the drum 16 includes the fan 250 in the form of one or more blades 272, separate from structural supports 272, to drive the process air (A) as the drum 16 rotates. The blades 272 are radially spaced from the drive shaft 252 and while illustrated as having an outer diameter equivalent to an outer diameter of the end wall 258, the blades 272 can have any diameter required to effectively drive the process air (A) through the air recirculation conduit 42.

The aspects of the disclosure described herein disclose a laundry treating appliance, for example, a dryer or a combination washer/dryer, as well as a laundry treating method for said laundry treating appliance, wherein an exterior wall of a cabinet exposed to ambient air can be leveraged in a drying system and vanes provided to an end wall of a drum can be used to drive process air. Using exterior cabinet walls to form a portion of a condenser eliminates the need for additional parts in an air conduit system in the appliance. Utilizing drum rotation to drive process air in a drying system eliminates the need for a blower in the system. This results in an increased appliance capacity and larger treatment chamber volumes as well as reduced manufacturing costs. In addition, the elimination of a blower in aspects of the disclosure results in a virtually noiseless drying operation.

The combination washer/dryer 10 can further include all the systems typically required for performing laundry treating operations, portions of which are not illustrated herein for the sake of brevity, including but not limited to, a drive system for rotating the drum 16 within the tub 14, a liquid supply system for supplying water to the combination washer/dryer 10 for use during a cycle of operation that can include a source of water, such as a household supply, a dispensing system for dispensing treating chemistry to the treating chamber 24 during a cycle of operation, and a control system for controlling the operation of the combination washer/dryer 10 located within the cabinet 12 and including the user interface 69 operably coupled with the control system and includes the controller 60.

To the extent not already described, the different features and structures of the various aspects can be used in combination with others as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure.

What is claimed is:

1. A combination washer/dryer, for washing and drying laundry, comprising:

a cabinet defining a cabinet interior with at least one exterior wall at least partially enclosing the interior;

a tub located within the cabinet interior and defining a tub interior with a first access opening;

a rotatable drum located within the tub interior for rotation about a rotation axis and defining a treating chamber with a second access opening, which is aligned with the first access opening, the rotatable drum comprising a rear wall defining a fan;

a closure moveably mounted to the cabinet and selectively movable between open/closed positions to open/close at least one of the first and second access openings;

an air recirculation conduit having an inlet fluidly coupled to a first portion of the treating chamber and an outlet fluidly coupled to a second portion of the treating chamber, which is different than the first portion; and a condenser fluidly coupled to the recirculation conduit.

2. The combination washer/dryer of claim 1, wherein the fan is fluidly coupled to the air recirculation conduit to flow air from the treating chamber, through the condenser, and back to the treating chamber.

3. The combination washer/dryer of claim 1, wherein the fan comprises at least one blade and wherein rotation of the drum causes the flowing of air.

4. The combination washer/dryer of claim 3, wherein the rotatable drum comprises a peripheral wall defining the second access opening and a rear wall opposite the second access opening, and the at least one blade is located on an exterior of one of the peripheral wall and the rear wall.

5. The combination washer/dryer of claim 3, wherein the inlet for the air recirculation conduit is located in the tub and confronts the rear wall of the drum, and the at least one blade of the drum forces air into the inlet for the air recirculation conduit as the drum is rotated.

6. The combination washer/dryer of claim 3, wherein the at least one blade comprises multiple blades radially spaced from each other relative to the rotation axis.

7. The combination washer/dryer of claim 6, wherein the multiple blades are radially spaced from the rotation axis.

8. The combination washer/dryer of claim 3, wherein the at least one blade is not a structural rib for the drum.

9. The combination washer/dryer of claim 1, wherein the fan comprises one or more ribs.

10. The combination washer/dryer of claim 9, wherein the one or more ribs are radially spaced.

11. The combination washer/dryer of claim 9, wherein the one or more ribs provide structural support to the rear wall of the drum.

12. The combination washer/dryer of claim 1, further comprising one or more ribs for providing structural support to the rear wall of the drum and one or more fan blades for forcing air into the inlet for the air recirculation conduit as the drum is rotated.

13. The combination washer/dryer of claim 1, wherein the condenser has at least two fluidly connected condensing chambers.

14. The combination washer/dryer of claim 13, wherein at least one of the at least two condensing chambers is defined at least in part by the at least one exterior wall.

15. The combination washer/dryer of claim 14, wherein the cabinet comprises at least two exterior walls, with at least a portion of each of the two exterior walls at least partially defining at least one the at least two condensing chambers.

16. The combination washer/dryer of claim 13, wherein the cabinet comprises multiple exterior walls, with a different one of the multiple exterior walls forming a portion of the at least two condensing chambers.

17. The combination washer/dryer of claim 16, wherein the multiple exterior walls comprise first and second side walls and the at least two condensing chambers comprise first and second condensing chambers corresponding to the first and second side walls.

18. The combination washer/dryer of claim 17, wherein the first and second side walls are opposite each other.

19. The combination washer/dryer of claim 1, wherein the condenser has a condensing chamber defined at least in part by the at least one exterior wall.

20. The combination washer/dryer of claim 19, wherein the at least one exterior wall is a rear wall.

* * * * *